US007250717B2

(12) United States Patent
Hwang

(10) Patent No.: US 7,250,717 B2
(45) Date of Patent: Jul. 31, 2007

(54) FLAT PANEL DISPLAY WITH IMPROVED ANODE ADHESION

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/999,142

(22) Filed: Nov. 29, 2004

(65) Prior Publication Data

US 2005/0134169 A1 Jun. 23, 2005

(30) Foreign Application Priority Data

Nov. 28, 2003 (KR) ..... 10-2003-0085474

(51) Int. Cl.
*H01J 1/62* (2006.01)

(52) U.S. Cl. ..... 313/496; 313/495

(58) Field of Classification Search ..... 313/495–497, 313/635, 479

See application file for complete search history.

(56) References Cited

U.S. PATENT DOCUMENTS

2003/0107311 A1* 6/2003 Radigan et al. ..... 313/495
2005/0122030 A1* 6/2005 Sakamoto et al. ..... 313/496

* cited by examiner

*Primary Examiner*—Joseph Williams
*Assistant Examiner*—Bumsuk Won
(74) *Attorney, Agent, or Firm*—Christie, Parker & Hale, LLP

(57) ABSTRACT

A flat panel display with improved adhesion of the anode to the second substrate is disclosed. The adhesion of the anode to the second substrate is reinforced to prevent damage to the anode at the spacer formation area and to stably adhere the phosphor layer to the anode. The flat panel display comprises first and second substrates each facing each other and separated from each other by a distance. An electron emission unit is formed on the first substrate. A plurality of phosphor layers are formed on the second substrate. An anode is formed on the second substrate covering the phosphor layers and the non-light emitting regions between the phosphor layers. In the non-light emitting regions, the anode is placed on the second substrate without leaving a gap between the anode and the second substrate.

14 Claims, 8 Drawing Sheets

FLAT PANEL DISPLAY WITH IMPROVED ANODE ADHESION

CROSS-REFERENCE TO RELATED APPLICATION

This application claims priority of Korean Patent Application number 10-2003-0085474, filed Nov. 28, 2003, the entire disclosure of which is incorporated herein by reference.

FIELD OF THE INVENTION

The present invention is directed to a flat panel display, and more particularly to a flat panel display exhibiting strengthened adhesion of the anode to the substrate having phosphor layers.

BACKGROUND OF THE INVENTION

Generally, a flat panel display includes a vacuum vessel having first and second substrates, each facing the other and separated from each other by a distance. Spacers are formed between the first and second substrates. In a flat panel display, electrons are emitted from electron emission sources located on the first substrate. These emitted electrons then collide with phosphor layers located on the second substrate. These collisions emit light and thereby display the desired images.

The electron emission sources located on the first substrate may comprise either hot or cold cathodes. Among the known electron emission sources comprising cold cathodes are the field emitter array (FEA) type, the metal-insulator-metal (MIM) type, the metal-insulator-semiconductor (MIS) type, the surface conduction emitter (SCE) type, and the ballistic electron surface emitter (BSE) type.

In order to force the electrons emitted from the electron emission sources on the first substrate toward the phosphor layers on the second substrate, the second substrate is kept in a high potential state. In a common flat panel display, this high potential state is maintained by positioning an anode on the second substrate. First, black layers are formed on the second substrate between each of the phosphor layers. These black layers provide screen contrast. The anode comprises a metallic film and is positioned over the black layers and the phosphor layers. To maintain a high potential state, a positive voltage of several hundred to several thousand volts, is applied to the anode.

The phosphor layers comprise phosphor particles several micrometers in size. The anode has a thickness of several hundred angstroms in order to facilitate electron transmission. When the metallic material is directly deposited on the phosphor layers, it does not uniformly cover the surface of the phosphor particles. Instead, the metallic material is intermittently broken, making it difficult to form a uniform metallic film.

Therefore, flat panel displays commonly comprise an intermediate layer located on the surface of the second substrate, over the phosphor layers and the black layers. The intermediate layer serves to flatten the surface of the second substrate. The metallic material is then deposited over the intermediate layer to form the anode. However, the intermediate layer is removed from the second substrate upon firing, leaving a predetermined gap between the anode and the phosphor layers and black layers. Accordingly, the adhesion of the anode to the second substrate is significantly weakened, and a stable anode is difficult to form.

As a result, the anode is likely to be damaged at the spacer formation area due to contact of the spacers with the surface of the anode. Consequently, the adhesive force of the spacers is weakened. After firing, the adhesive force of the phosphor layers is also weakened. The weakened adhesion of the spacers and the phosphor layers to the anode functionally limits the ability of the anode to support the phosphor layers.

SUMMARY OF THE INVENTION

The present invention is directed to a flat panel display with strengthened adhesion of the anode to the second substrate. This strengthened adhesion of the anode to the second substrate prevents damage to the anode at the spacer formation area and enhances adhesion of the phosphor layers to the anode.

In one embodiment, the flat panel display includes first and second substrates, each facing each other, and separated from each other by a distance. An electron emission unit is located on the first substrate. Phosphor layers are formed on the second substrate. An anode is formed on the second substrate covering the phosphor layers and the non-light emitting regions between the phosphor layers. In the non-light emitting regions of the second substrate, the anode is positioned on the second substrate without leaving a gap between the anode and the second substrate.

In another embodiment, spacers are formed between the first and second substrates. The areas on the second substrate surrounding each spacer are the spacer formation areas. In this embodiment, the anode is deposited only on the spacer formation areas of the second substrate, and is positioned without leaving a gap between the anode and the second substrate.

In another alternative embodiment, the phosphor layers comprise a plurality of red, green and blue phosphor layers. In this embodiment, the anode is placed on the second substrate between the phosphor layers, but is not placed on the phosphor layers. The anode is placed on the second substrate between the phosphor layers without leaving a gap between the anode and the second substrate.

In yet another embodiment, the flat panel display further comprises a plurality of black layers placed on the second substrate between the phosphor layers. In this embodiment, the anode is formed on the black layers without leaving a gap between the black layers and the anode.

In still another embodiment, the flat panel display comprises first and second substrates each facing each other and separated from each other by a distance. The flat panel display further comprises an electron emission unit formed on the first substrate. In addition, at least one transparent anode is formed on the second substrate. Phosphor layers are formed on the anode. A metallic film is formed on the entire surface of the second substrate and covers the phosphor layers and the non-light emitting regions between the phosphor layers. In the non-light emitting regions between the phosphor layers, the metallic film is placed on the second substrate without leaving a gap between the metallic film and the second substrate.

Alternatively, spacers are placed between the first and second substrates. The areas on the second substrate surrounding each spacer are spacer formation areas. The metallic film is placed only in the spacer formation areas of the second substrate, and is placed without leaving a gap between the second substrate and the metallic film.

In another alternative, the phosphor layers comprise a plurality of red, green and blue phosphor layers. The metallic film is placed on the transparent anode only in the non-light emitting regions between the phosphor layers, and is placed on the anode without leaving a gap between the anode and the metallic film.

In yet another alternative, the flat panel display further comprises a plurality of black layers placed on the second substrate in the non-light emitting regions between the phosphor layers. The metallic film is formed on the black layers without leaving a gap between the metallic film and the black layers.

The electron emission unit located on the first substrate comprises gate electrodes covered by an insulating layer, and cathodes positioned over the insulating layer. The gate electrodes and cathodes proceed substantially perpendicular to each other. Electron emission sources contact the cathodes.

One method of manufacturing an embodiment of a flat panel display according to this invention comprises first forming a plurality of phosphor layers on the second substrate. The areas on the second substrate where the phosphor layers are positioned are the light emitting regions. An intermediate layer is then formed over the phosphor layers on the second substrate, but is not formed in the non-light emitting regions between the phosphor layers. An anode is then formed on the entire surface of the second substrate covering the intermediate layer and the non-light emitting regions. The second substrate is then fired, thereby removing the intermediate layer. An electron emission unit is then formed on the first substrate.

Another method for manufacturing an embodiment of a flat panel display according to the present invention comprises first forming at least one transparent anode on the second substrate. Phosphor layers are then formed on the anode. The areas on the second substrate where the phosphor layers are located are the light emitting regions. An intermediate layer is then formed on the surface of the second substrate covering the phosphor layers, but not covering the non-light emitting regions between the phosphor layers. A metallic film is then formed on the entire surface of the second substrate covering the intermediate layer and the non-light emitting regions between the phosphor layers. The second substrate is then fired, thereby removing the intermediate layer. An electron emission unit is then formed on the first substrate.

BRIEF DESCRIPTION OF THE DRAWINGS

The present invention, and many of its advantages, will be better understood by reference to the following detailed description when considered in conjunction with the accompanying drawings, wherein.

DETAILED DESCRIPTION

Figure 1:
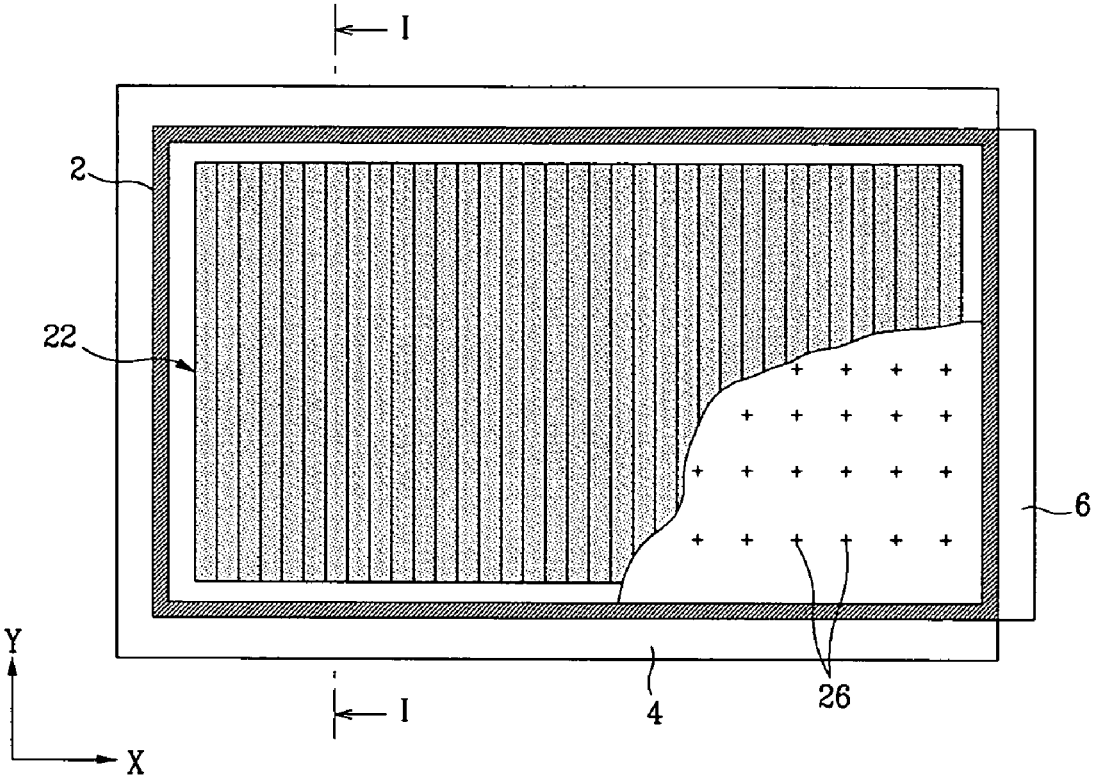
FIG. 1 is a plan view of a flat panel display according to one embodiment of the present invention.
Figure 2:
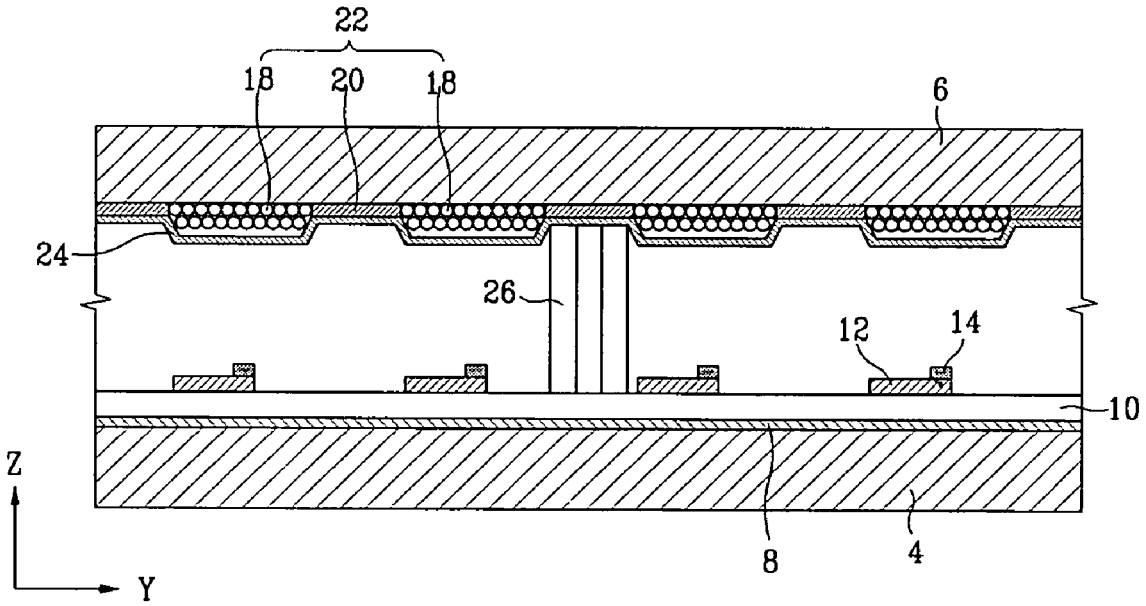
FIG. 2 is a cross-sectional view of the flat panel display of FIG. 1 taken along line I-I.

FIGS. 1 and 2 illustrate a flat panel display using FEA type electron emission sources. As shown, the flat panel display comprises a first substrate 4 and a second substrate 6 sealed together by a frit seal 2 to form a vacuum vessel. An electron emission unit is formed on the first substrate 4. The electron emission unit emits electrons which form visible rays at the second substrate 6, which then display the desired images.

Specifically, as shown in FIG. 2, gate electrodes 8 are formed on the first substrate 4 in a striped pattern, each gate electrode 8 proceeding in the Y direction. An insulating layer 10 is formed on the surface of the first substrate 4 covering the gate electrodes 8. Cathodes 12 are formed over the insulating layer 10 in a striped pattern, each cathode 12 proceeding in the X direction, perpendicular to the direction of the gate electrodes 8.

The regions where the gate electrodes 8 cross the cathodes 12 are defined as pixel regions. Electron emission sources 14 are placed on the edge of each pixel region, each electron emission source 14 being placed on the same side of each pixel region. Preferably, each electron emission source 14 comprises a carbon-based material. Non-limiting examples of carbon-based materials suitable for use as an electron emission source 14 include carbon nanotube, graphite, diamond-like carbon, fullerene ($C_{60}$), and mixtures thereof. Alternatively, each electron emission source 14 comprises a nanometer-size material. Non-limiting examples of suitable nanometer-size materials for use as electron emission sources 14 include nano-tube, nano-wire, nano-fiber, and mixtures thereof.

The first substrate 4 and second substrate 6 each face each other and are spaced apart from each other by a predetermined distance. Red, green and blue phosphor layers 18 are formed on the surface of the second substrate 6. Black layers 20, for improving screen contrast, are formed on the non-light emitting regions between the phosphor layers 18. The black layers 20, along with the phosphor layers 18, form a phosphor screen 22. An anode 24 is placed over the phosphor screen 22. Preferably, the anode 24 is formed of a metallic material such as aluminum, which improves the brightness of the screen through the metal back effect.

A plurality of spacers 26 are positioned between the first substrate 4 and the second substrate 6. The spacers 26 stably maintain the distance between the first substrate 4 and the second substrate 6. The spacers 26 are positioned at the non-light emitting regions, that is, at the locations of the black layers 20, so that they do not affect the discharge of electron beams or the light emission of the phosphor layers 18.

Upon application of predetermined driving voltages to the gate electrodes 8 and cathodes 12, electric fields are formed around the electron emission sources 14. These electric fields are formed by the difference in voltage between the gate electrodes 8 and the cathodes 12. Electrons are then emitted from the electron emission sources 14. Upon application of a positive voltage measuring several hundred to several thousand volts to the anode 24, the electrons emitted from the electron emission sources 14 excite the phosphor layers 18, creating visible rays, thereby displaying the desired images.

The flat panel display according to this invention exhibits improved adhesion of the anode 24 to the second substrate 6. In particular, the adhesive strength of the anode 24 at the non-light emitting regions between the phosphor layers, for example, the spacer formation areas, is improved. In one embodiment, as shown in FIG. 2, the anode 24 is deposited on the non-light emitting regions of the second substrate 6 without leaving a gap between the anode 24 and the second substrate. Specifically, the anode 24 adheres to the black layers 20 without leaving a gap between the black layers 20 and the anode 24. This anode 24 may be formed by directly depositing a metallic material onto the black layers 20.

However, the anode 24 is spaced apart from the phosphor layers 18 by a predetermined gap. The gap is formed by the removal of an intermediate layer (not shown) formed on the phosphor layers 18. The intermediate layer is removed upon firing of the second substrate, thereby separating the anode 24 from the phosphor layers 18. Therefore, the anode 24 is separated from the phosphor layers 18 by a predetermined gap while the anode 24 directly contacts the black layers 20 without leaving a gap.

Figure 3:
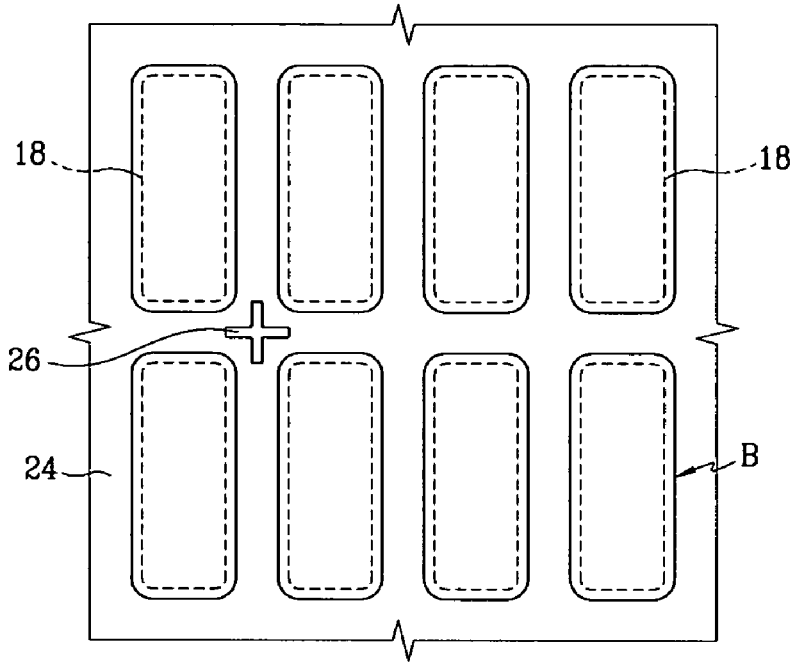
FIG. 3 is a bottom view of the second substrate of one embodiment of a flat panel display according to the invention.
Figure 4:
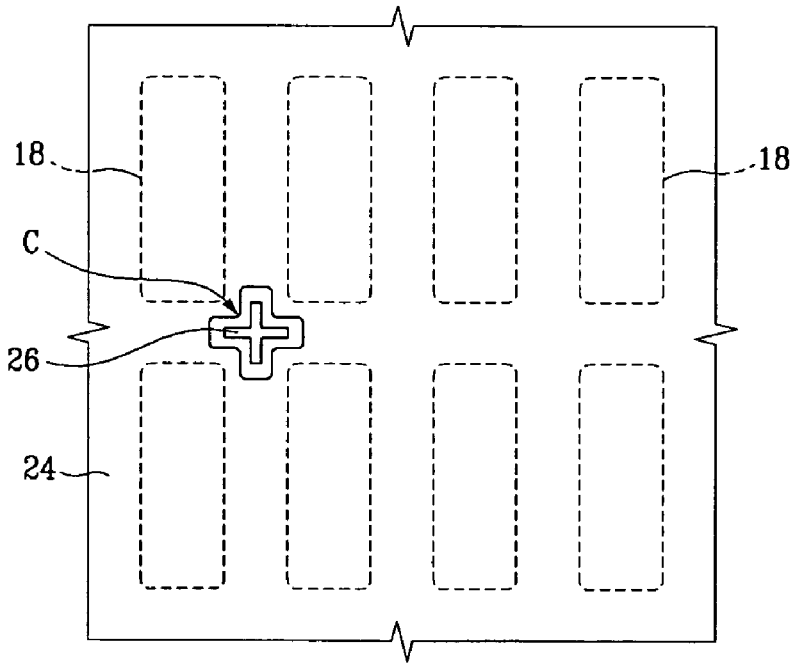
FIG. 4 is a bottom view of the second substrate of another embodiment of a flat panel display according to the invention.

In one embodiment, as shown in FIG. 3, the anode 24 is positioned on the black layers 20 without leaving a gap between the anode 24 and the black layers 20. The anode covers the entire area of the second substrate except for the regions B surrounding the phosphor layers 18. Alternatively, as shown in FIG. 4, the anode 24 may cover only regions C on the second substrate directly surrounding the spacer formation area. The regions C covered by the anode 24 are larger than the spacer formation areas.

In this embodiment, the adhesion of the anode 24 to the second substrate 6 is reinforced, thereby preventing damage to the anode 24 at the spacer formation area and improving the adhesive force of the spacers 26 to the second substrate 6. Although the adhesion of the phosphor layers 18 to the second substrate 6 is weakened upon firing of the second substrate, the adhesion-reinforced anode 24 rigidly adheres the phosphor layers 18 to the second substrate. Accordingly, the electric potentials that accumulate at the phosphor layers 18 are easily discharged by the stabilized structure of the anode 24.

The anode 24, therefore, reduces deterioration of the phosphor layers 18 and prevents arcing that occurs due to electric potentials that accumulate at the phosphor layers 18. As a result, higher voltages can be applied to the anode 24, thereby improving the brightness of the screen.

Although the flat panel displays of the present invention are described as using FEA type electron emission sources, the invention is not limited to flat panel displays using those electron emission sources. Rather, the flat panel displays of the present invention may use any electron emission sources, including but not limited to FEA types, MIM types, MIS types, SCE types, and BSE types.

Figure 5:
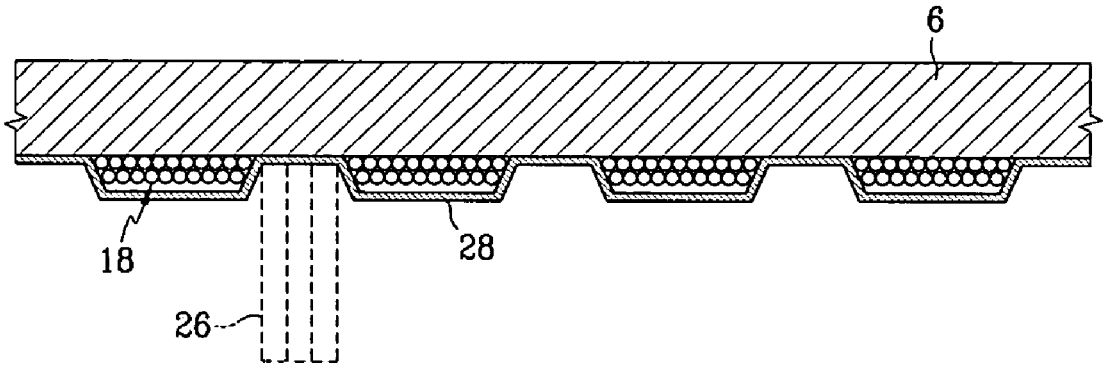
FIG. 5 is a cross-sectional view of the second substrate of one embodiment of a flat panel display according to the invention.

The phosphor layers 18 and anode 24 may also vary. For example, FIGS. 5 through 8 show second substrates 6 having different phosphor layers and anodes. As shown in FIG. 5, the red, green and blue phosphor layers 18 may be spaced apart from each other and the black layers may be omitted. In this embodiment, the anode 28 is placed on the second substrate 6 between the phosphor layers 18, and is adhered to the second substrate 6 without leaving a gap.

Figure 6:
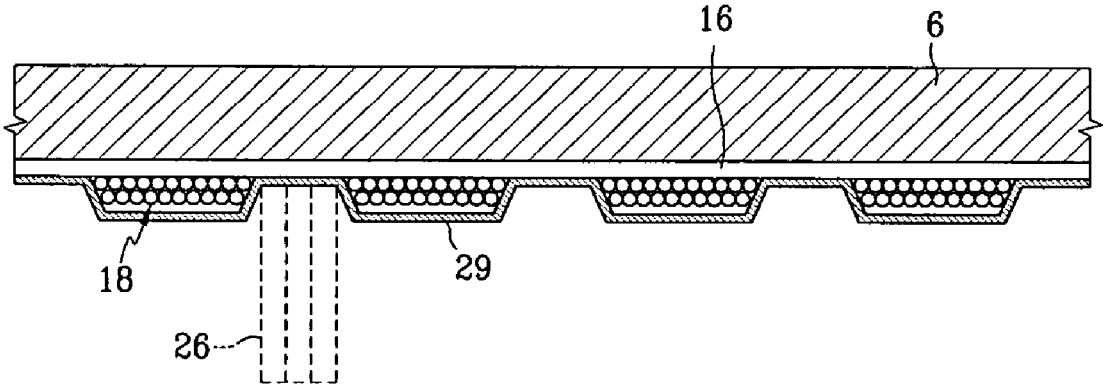
FIG. 6 is a cross-sectional view of the second substrate of another embodiment of a flat panel display according to the invention.

In an alternative embodiment, shown in FIG. 6, the flat panel display comprises a transparent anode 16 formed on the second substrate 6, phosphor layers 18 formed on the anode 16, and a metallic film 29 formed over the entire internal surface of the second substrate 6. In this embodiment, the anode 16 is formed of a transparent conductive material such as indium tin oxide (ITO). Part of the metallic film 29 is placed on the anode 16 between the phosphor layers 18 without leaving a gap between the anode 16 and the metallic film 29. The areas between the phosphor layers 18 where the metallic film 29 is placed over the anode are non-light emitting areas.

Figure 7:
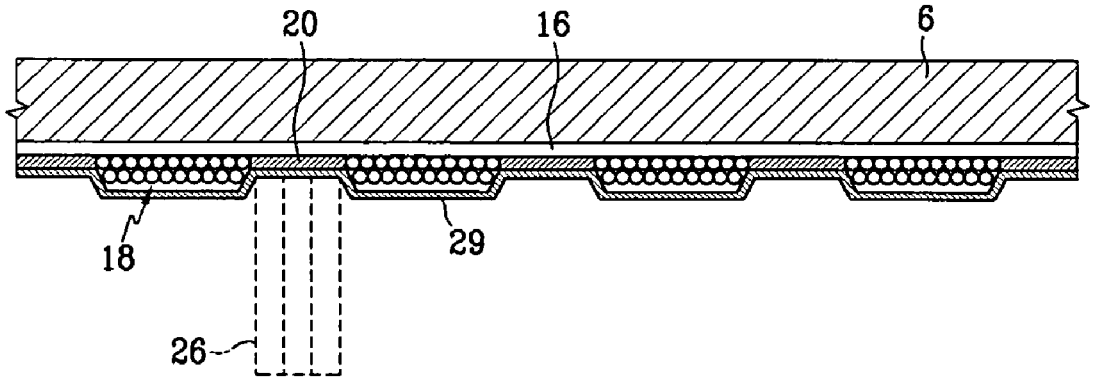
FIG. 7 is a cross-sectional view of a third embodiment of a flat panel display according to the invention.

In another alternative embodiment, shown in FIG. 7, the flat panel display comprises the basic structure of the flat panel display of FIG. 6 but further comprises black layers 20 formed between the phosphor layers 18 for improving screen contrast. Part of the metallic film 29 is placed on the black layers 20 without leaving a gap between the metallic film 29 and the black layers 20. The areas between the phosphor layers 18 where the metallic film 29 is placed over the black layers 20 are non-light emitting areas.

Figure 8:
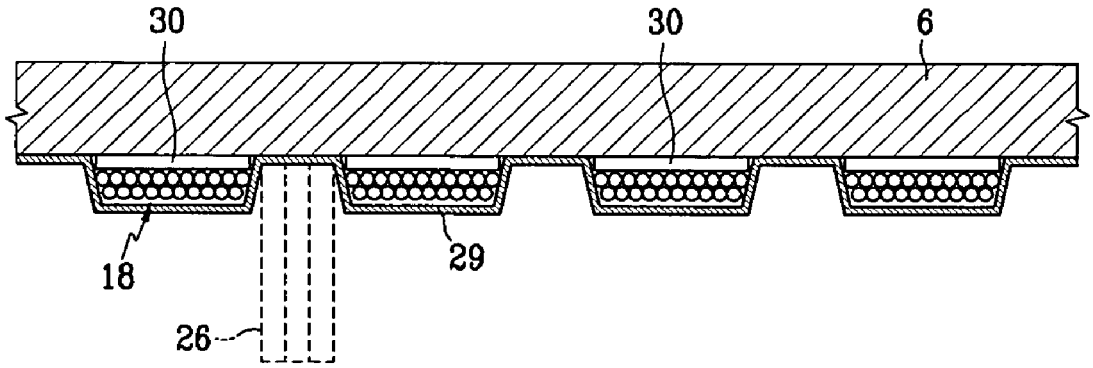
FIG. 8 is a cross-sectional view of a fourth embodiment of a flat panel display according to the invention.

In yet another embodiment, shown in FIG. 8, the anode 30 is positioned on the second substrate 6 in a striped pattern. The phosphor layers 18 are formed on the anode 30 with no black layer. Part of the metallic film 29 is placed on the second substrate between the phosphor layers 18, and is tightly adhered to the second substrate 6 without leaving a gap between the metallic film and the second substrate.

Figure 9A:
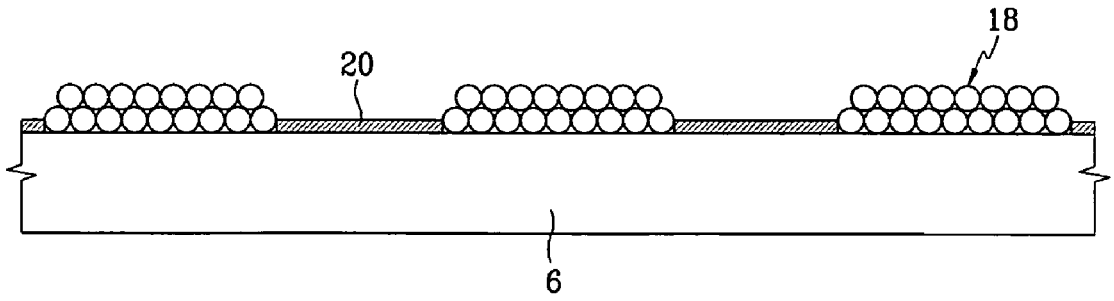
FIGS. 9A through 9D are cross-sectional views of the second substrate of one embodiment of a flat panel display according to the invention, illustrating the steps of one method of manufacturing the flat panel display.
Figure 9B:
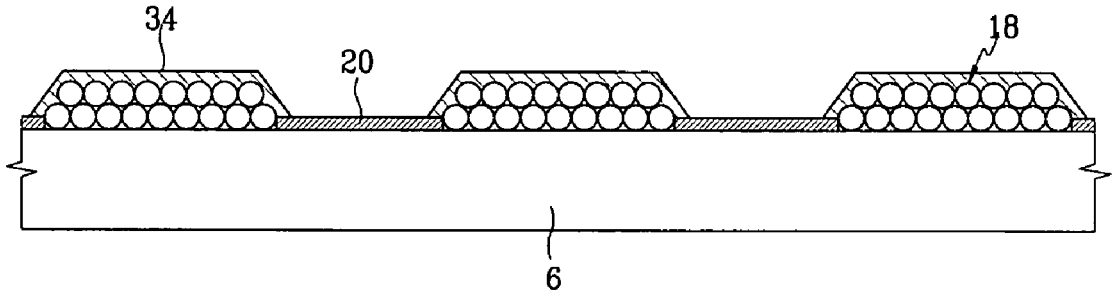

FIGS. 9A through 9Dd illustrate a method of manufacturing one exemplary embodiment of a flat panel display according to the present invention. As shown in FIG. 9A, black layers 20 are formed on the second substrate over the non-light emitting areas. The black layers 20 may comprise a thin film of, for example, chrome oxide, or a thick film of, for example, graphite. Red, green and blue phosphor layers 18 are then formed between the black layers 20 in the light emitting areas.

The location of the anode 24 is then determined and reserved. As shown in FIG. 3 or 4 and in FIG. 9B, an intermediate, surface flattening layer 34, is then formed over the phosphor layers 18 or over both the phosphor layers 18 and the black layers 20. However, the intermediate layer is not formed over the location reserved for the anode 24.

The intermediate layer 34 is formed over either the phosphor layers 18 or over the phosphor layers 18 and the black layers 20 by selectively coating the composition of the intermediate layer over the desired position(s). Alternatively, the intermediate layer 34 is formed over the desired location(s) by forming a photosensitive intermediate layer over the entire surface of the phosphor layers 18 and black layers. The photosensitive intermediate layer is then partially exposed to light which selectively hardens portions of the intermediate layer 34. The non-hardened portions of the intermediate layer 34 are then removed.

Figure 9C:
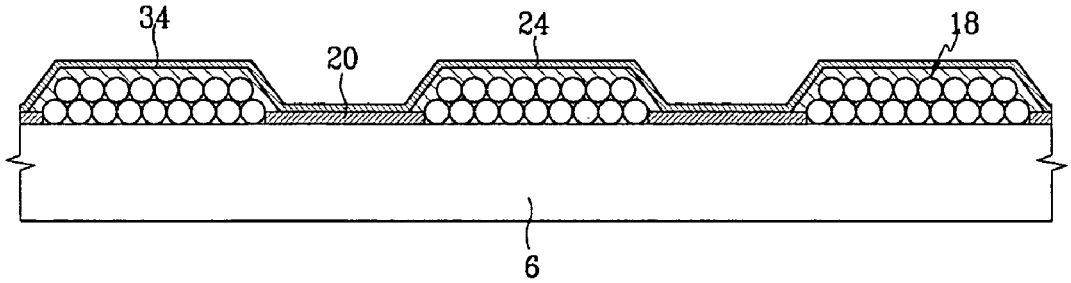

Next, as shown in FIG. 9C, a metallic material such as aluminum, is vapor-deposited or sputtered onto the entire surface of the second substrate 6 over the intermediate layer 34 to form an anode 24. The anode 24 is in direct contact with the black layers 20 at the locations where the intermediate layer 34 was removed.

Figure 9D:
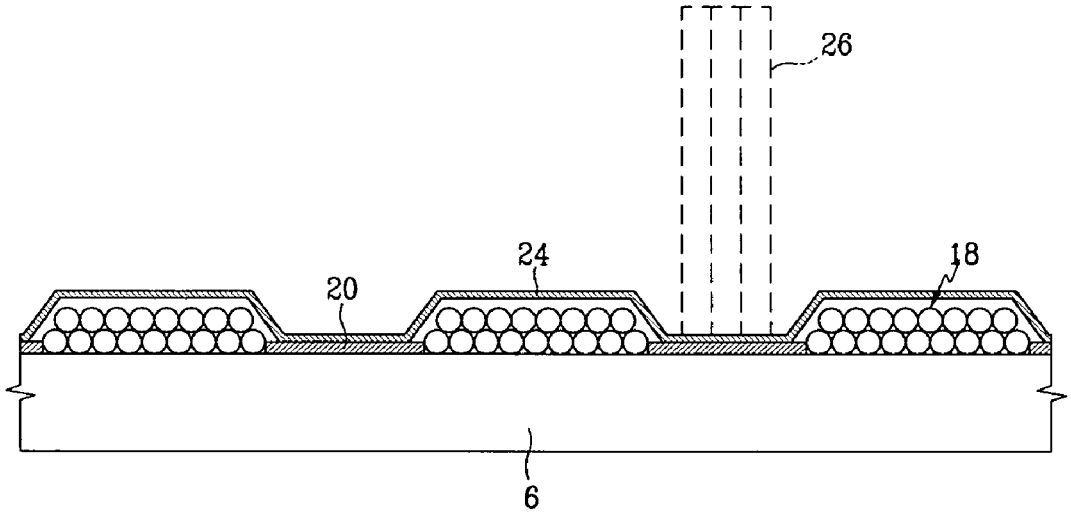

The second substrate 6 is then fired to remove the intermediate layer 34, completing the structure of the second substrate, as shown in FIG. 9D. After removal of the intermediate layer 34, the portion of the anode 24 that is positioned on the phosphor layers 18 becomes spaced apart from the phosphor layers 18 by a predetermined gap. Therefore, the portion of the anode 24 positioned on the phosphor layers 24 is structurally different from the portion of the anode 24 positioned on the black layers 20.

Finally, an electron emission unit is formed on the first substrate. Spacers are then arranged on the insulating layer of the electron emission unit and positioned between the first and second substrates. The first and second substrates are then sealed together by a sealant and the internal space between the first and second substrates is removed by an exhaust (not shown), thereby completing the flat panel display. Alternatively, the black layers 20 formed on the second substrate 6 may be omitted.

Figure 10A:
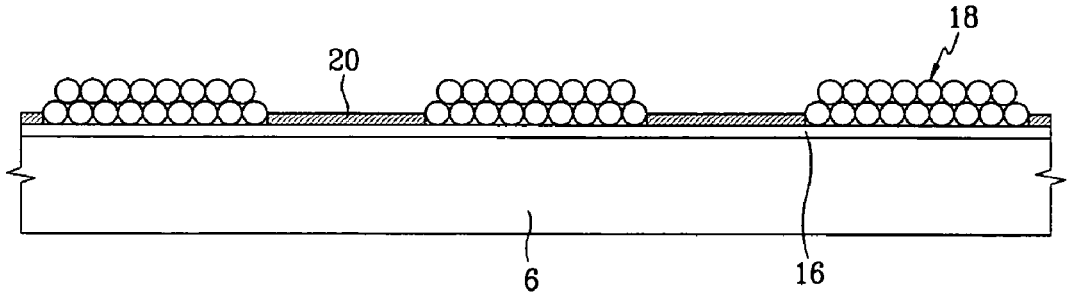
FIGS. 10A through 10D are cross-sectional views of the second substrate of another embodiment of a flat panel display according to the invention, illustrating the steps of another method of manufacturing the flat panel display.
Figure 10B:
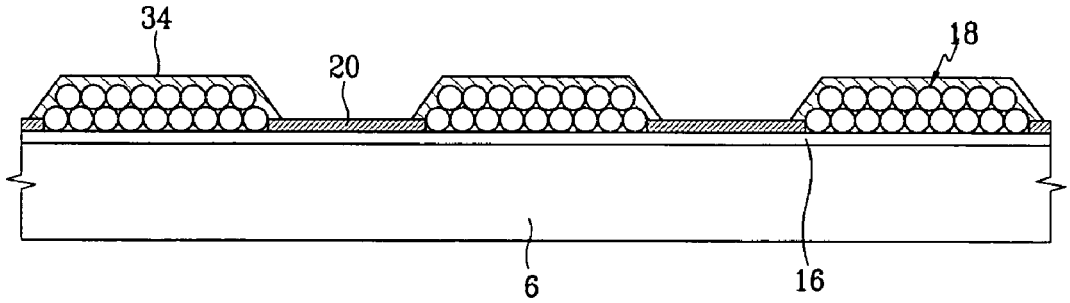
Figure 10C:
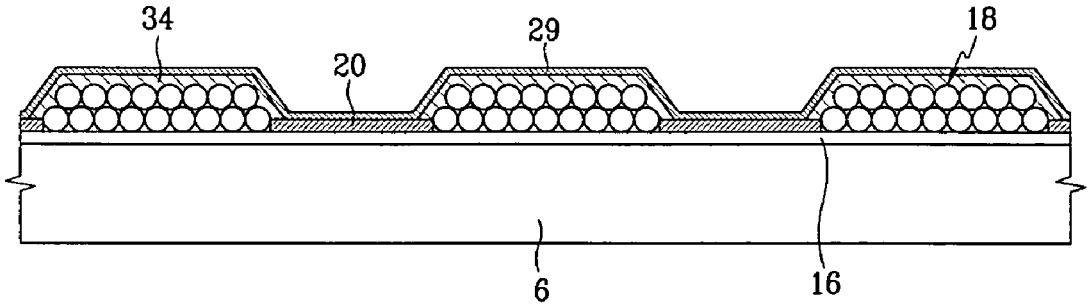
Figure 10D:
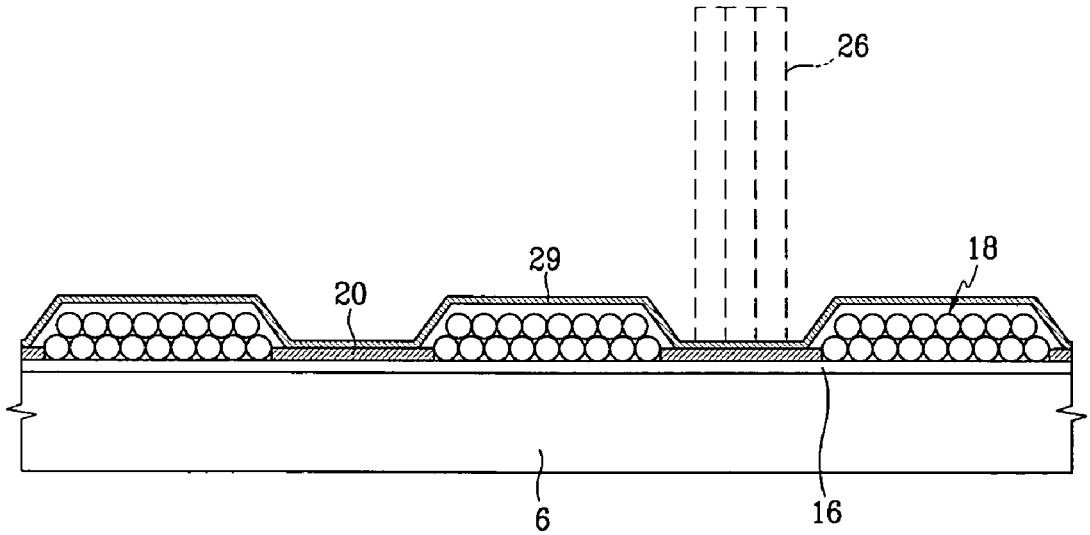

FIGS. 10A through 10B illustrate a method of manufacturing another exemplary embodiment of a flat panel display according to the present invention. As shown in FIG. 10A a transparent conductive layer comprising a conductive material such as ITO, is formed on the second substrate 6 as an anode 16. Black layers 20 are then formed over the anode 16 in the non-light emitting areas. Red, green and blue phosphor layers 18 are then formed on the second substrate 6 between the black layers 20 in the light emitting areas.

The location of the metallic film 29 is then determined and reserved. As shown in FIG. 3 or 4 and in FIG. 10B, an intermediate, surface flattening layer 34, is then selectively formed over the phosphor layers 18 or over both the phosphor layers 18 and the black layers 20, in the manner described above. However, the intermediate layer is not formed over the location reserved for the metallic film 29.

Next, as shown in FIG. 9C, a metallic material such as aluminum, is vapor-deposited or sputtered onto the entire surface of the second substrate 6 over the intermediate layer 34 to form a metallic film 29. The metallic film 29 is in direct contact with the black layers 20 at the locations where the intermediate layer 34 was removed.

The second substrate 6, including the metallic film 29, is then fired to remove the intermediate layer 34, completing the structure of the second substrate, as shown in FIG. 9D. After removal of the intermediate layer 34, the portion of the metallic film 29 that is positioned on the phosphor layers 18 becomes spaced apart from the phosphor layers 18 by a predetermined gap. Therefore, the portion of the metallic film 29 positioned on the phosphor layers 24 is structurally different from the portion of the metallic film 29 positioned on the black layers 20. Alternatively, the anode 16 may be positioned on the second substrate 16 in a striped pattern, and the black layers 20 may be omitted.

Finally, an electron emission unit is formed on the first substrate. Spacers are then arranged on the insulating layer of the electron emission unit and positioned between the first and second substrates. The first and second substrates are then sealed together by a sealant and the internal space between the first and second substrates is removed by an exhaust (not shown), thereby completing the flat panel display.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A flat panel display comprising:

a first substrate and a second substrate, each facing each other and separated from each other by a distance;

an electron emission unit positioned on the first substrate;

a plurality of phosphor layers positioned along the second substrate, areas of the second substrate not having phosphor layers being non-light emitting regions; and an anode positioned on the second substrate and covering the plurality of phosphor layers;

wherein at least one non-phosphor layer and/or the anode is positioned on the second substrate in the non-light emitting regions without leaving a gap between the second substrate and the at least one non-phosphor layer and/or the anode, while the anode is separated from the phosphor layers by a gap.

2. The flat panel display of claim 1, further comprising spacers placed between the first and second substrates, wherein areas on the second substrate surrounding the spacers are spacer formation areas and the anode is positioned on the spacer formation areas of the second substrate, the spacer formation areas covered by the anode being non-light emitting regions.

3. The flat panel display of claim 1, wherein the plurality of phosphor layers comprises a plurality of red, green and blue phosphor layers, a portion of the anode being placed on the second substrate between the phosphor layers without leaving a gap between the anode and the second substrate.

4. The flat panel display of claim 1, wherein the plurality of phosphor layers comprises a plurality of red, green and blue phosphor layers, the flat panel display further comprising a plurality of black layers positioned on the second substrate between the phosphor layers, the anode being positioned over the black layers without leaving a gap between the anode and the black layers.

5. The flat panel display of claim 1, wherein the electron emission unit comprises a plurality of gate electrodes and a plurality of cathodes, the electron emission unit further comprising an insulating layer positioned on the first substrate between the gate electrodes and cathodes, the gate electrodes being positioned substantially perpendicular to the cathodes, the electron emission unit further comprising a plurality of electron emission sources contacting the cathodes.

6. A flat panel display comprising:

a first substrate and a second substrate, each facing each other and separated from each other by a distance;

an electron emission unit positioned on the first substrate;

a common transparent anode positioned on the second substrate;

a plurality of phosphor layers positioned along the common transparent anode, areas of the second substrate not having phosphor layers being non-light emitting regions; and a metallic film positioned on the second substrate and covering the phosphor layers;

wherein the metallic film is positioned on the second substrate without leaving a gap between the second substrate and the metallic film in the non-light emitting regions, while the metallic film is separated from the phosphor layers by a gap.

7. The flat panel display of claim 6, further comprising spacers positioned between the first and second substrates, wherein areas on the second substrate surrounding the spacers are spacer formation areas, the metallic film being positioned on the spacer formation areas of the second substrate, the spacer formation areas covered by the metallic film being non-light emitting regions.

8. The flat panel display of claim 6, wherein the plurality of phosphor layers comprises a plurality of red, green and blue phosphor layers, a portion of the metallic film being positioned on the common transparent anode between the phosphor layers without leaving a gap between the metallic film and the common transparent anode.

9. The flat panel display of claim 6, wherein the plurality of phosphor layers comprises a plurality of red, green and blue phosphor layers, the flat panel display further comprising a plurality of black layers positioned on the second substrate between the phosphor layers, the metallic film being positioned on the black layers without leaving a gap between the metallic film and the black layers.

10. The flat panel display of claim 6, wherein the common transparent anode comprises indium tin oxide.

11. A flat panel display comprising:

a first substrate and a second substrate, each facing each other and separated from each other by a distance;

an electron emission unit positioned on the first substrate;

a plurality of transparent anodes positioned along the second substrate;

a plurality of phosphor layers each positioned on a respective transparent anode, areas of the second substrate not having phosphor layers being non-light emitting regions; and a metallic film positioned on the second substrate, covering the phosphor layers and in contact with the second substrate in the non-light emitting regions;

wherein the metallic film is positioned on the second substrate without leaving a gap between the second substrate and the metallic film in the non-light emitting regions, while the metallic film is separated from the phosphor layers by a gap.

12. The flat panel display of claim 11, further comprising spacers positioned between the first and second substrates, wherein areas on the second substrate surrounding the spacers are spacer formation areas, the metallic film being positioned on the spacer formation areas of the second substrate, the spacer formation areas covered by the metallic film being non-light emitting regions.

13. The flat panel display of claim 11, wherein the plurality of phosphor layers comprises a plurality of red, green and blue phosphor layers, a portion of the metallic film being positioned on the second substrate between the phosphor layers without leaving a gap between the metallic film and the second substrate.

14. The flat panel display of claim 11, wherein the transparent anode comprises indium tin oxide.

* * * * *